United States Patent [19]

Gargrave et al.

[11] 4,434,644

[45] Mar. 6, 1984

[54] ROTARY BENDING AND FORMING DEVICES

[75] Inventors: Robert J. Gargrave, Kettering; John K. Thompson, West Carrollton; James F. Comstock, Kettering, all of Ohio

[73] Assignee: READY Tools, Inc., Dayton, Ohio

[21] Appl. No.: 339,133

[22] Filed: Jan. 13, 1982

[51] Int. Cl.[3] ..... B21D 5/04

[52] U.S. Cl. ..... 72/387

[58] Field of Search ..... 72/387, 319, 310, 308, 72/298, 305, 306, 388, 380, 321, 236; 384/408, 409, 410, 411, 412, 413

[56] References Cited

U.S. PATENT DOCUMENTS

| | | | |
|---|---|---|---|
| 105,146 | 7/1870 | Jeinsen | 384/410 |
| 2,640,343 | 6/1953 | Harkenrider | 384/409 |
| 2,963,066 | 12/1960 | Nelson | 72/319 |
| 3,301,034 | 1/1967 | Boettcher | 72/319 |
| 3,400,568 | 9/1968 | Brandner | 72/387 |
| 4,002,049 | 1/1977 | Randolph | 72/388 |
| 4,181,002 | 1/1980 | Eckhold | 72/387 |

FOREIGN PATENT DOCUMENTS

| | | | |
|---|---|---|---|
| 381437 | 5/1973 | U.S.S.R. | 72/236 |
| 618146 | 8/1978 | U.S.S.R. | 72/236 |

*Primary Examiner*—Gene P. Crosby

*Attorney, Agent, or Firm*—Jerome P. Bloom

[57] ABSTRACT

A bending and forming device is disclosed having an operating head and its holder features a holder which is a multi part structure including a saddle for seating the head and a releasably connected gib, a limited portion of which is adapted to releasably bear on and hold the head to and for a rocking or rotative movement thereof on its seat. The head is preferably a cylindrical body having a groove the length of its outer peripheral surface, the bounding walls of which groove determine the operation to which the head may be applied. The retention device is connected to the saddle so as to enable an easy adjustment of its position to accommodate variation in the dimension of the operating head or wear of the related parts. In preferred embodiments the saddle affords a concentrated load bearing surface for the head provided by relatively narrow, adjacent and relatively spaced, longitudinally extended, strip-like bearings. Preferred embodiments also feature slip interfit parts of the saddle on the head which are used to limit and control the rotative or rocking movements of the head in the course of its operation.

9 Claims, 6 Drawing Figures

ROTARY BENDING AND FORMING DEVICES

BACKGROUND OF THE INVENTION

This invention relates to improvements in prior art rotary bending and forming devices which (1) simplify the assembly and replacement of their parts; (2) render such devices more adaptable as to their application; (3) render such devices easier and more economical to maintain; (4) increase the effectiveness of the operation of such devices; (5) substantially increase the load accommodating capabilities of such devices; (6) inherently provide such devices with a longer and more satisfactory operating life.

By reason of the above features, embodiments of the present invention afford means and methods for achieving a significant advance in the art, opening the door to a new generation of bending and forming devices.

To the best of present knowledge and belief, the pertinent prior art is found in U.S. Pat. No. 4,002,049 which issued Jan. 11, 1977, and U.S. Pat. No. 4,181,002 which issued Jan. 1, 1980.

The present invention will be particularly described with reference to embodiments thereof which carry forward the basic concept and construction set forth in U.S. Pat. No. 4,002,049. However, this is only for purpose of illustration and not by way of limitation, either as to the form of its embodiment or its application. As will be seen from the following description, the use of the invention embodiments will not only facilitate the production of tooling in the nature of bending and forming devices but the use thereof will result in better quality end products, achieved with a savings in time and labor and correspondingly, costs.

SUMMARY OF THE INVENTION

The improvements of the present invention are embodied in a rotary bending and forming device comprising an operating head and a holder. In the preferred embodiment illustrated the operating head is a generally cylindrically formed rocker element having a groove continuous in length with its outer peripheral surface, the sides of which groove determine the nature and character of the bending or forming operation to which the tool will be applied.

Per the present invention, the holder comprises a saddle and a gib. The saddle comprises laterally spaced, generally parallel narrow, strip-like bearing surfaces. Such strip-like bearing surfaces provide a limited seat for the rocker element, in an arrangement which substantially increases the load accommodating capability of the saddle, for a given size, as compared to the saddles of the prior art which have similar application.

In preferred embodiments the rocker element and the saddle have portions which interrelate merely in the course of dropping the rocker element into its seated relation to the saddle. These interrelated portions define the precise limits of the rocking or rotative capabilities with reference to the saddle, in use. There may be optionally provided, in preferred embodiments of the invention, a simply arranged spring return mechanism which automatically moves the rocker element to its inoperative position, in which the groove in the rocker element is caused to face directly outward therefrom.

Once the rocker element is seated, the gib is releasably connected to the saddle to have a limited portion thereof overlie and lightly bear against and contain the rocker element to its seat. The construction and arrangement of the gib provides for a balanced and stable mount of the rocker element, which insures the proper orientation of its groove throughout the course of its application in a bending or forming procedure.

The gib and the saddle both embody devices for applying lubricant to the outer peripheral surface portion of the rocker element. In their preferred embodiment, these lubricating devices afford an economical means for insuring a smooth and effective function of the rocker element and an avoidance of unnecessary wear on the related parts.

The saddle incorporates a further limited bearing surface for the rocker element which is opposed to that provided by the gib. These bearing surfaces are not designed to load the rocker element, they serve basically to insure a duplicated function of the rocker element in the course of each of its successive operations in a given application.

Another feature of the invention is the manner of connecting and relating the gib to the saddle. This provides for adjustment of the gib to accommodate, within prescribed limits, the dimensional characteristics of the outer peripheral surface of the rocker element. The configuration of the gib is such, moreover, to enable one to electively tighten or to free its fit in the use thereof.

The invention embodiments may incorporate all or part of the features and benefits first enumerated and offer distinct advance in the art as well as provide savings in time, labor and cost, not only in their fabrication but in the application and maintenance thereof in equipment for use in bending and forming operations.

Accordingly, a primary object of the present invention is to provide rotary bending and forming devices which are economical to fabricate, more efficient and satisfactory in use, adaptable and adjustable to a wide variety of applications and unlikely to malfunction.

A further object of the invention is to simplify the construction of rotary bending and forming devices and to substantially increase their load accommodating capability as compared to that of similarly sized devices of the prior art.

A further object of the invention is to provide a construction and assembly for rotary bending and forming devices which facilitate the replacement or adjustment of their parts, as and when required.

An additional object is to provide rotary bending and forming apparatus having a composition and construction which is such that the rocker element will be inhibited from falling out of its holder and damaging equipment and material should it become fractured.

Another object of the invention is to provide a bearing arrangement for a rocker element in a rotary bending and/or forming device which renders it more effective in use and gives it a longer more satisfactory operating life.

An additional object of the invention is to provide rotary bending and/or forming units and parts thereof possessing the advantageous structural features, the inherent meritorious characteristics and the means and mode of use and application herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein is shown one but not necessarily the only form of embodiment of the present invention, FIG. 1 is a perspective view of a rotary bending and forming apparatus in accordance with the present invention;

Figure 1:
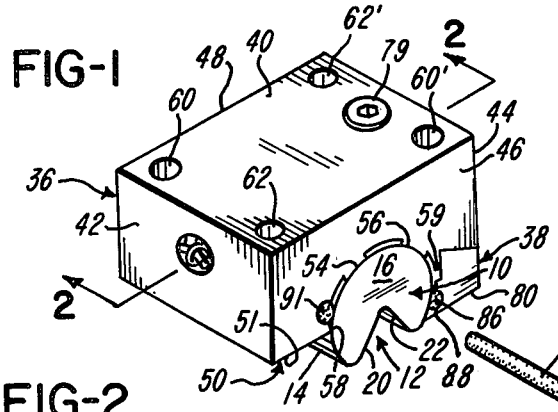
Figure 2:
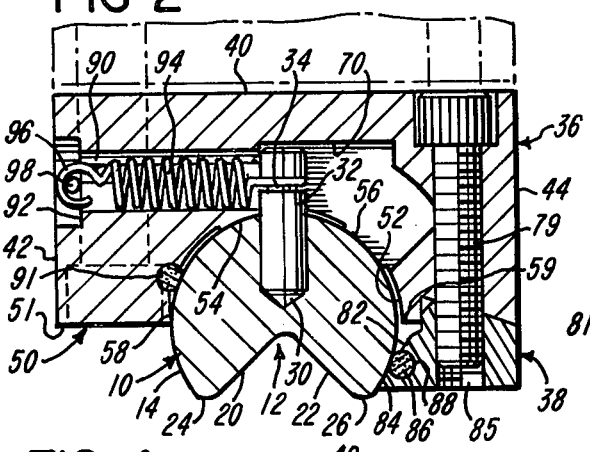
FIG. 2 is a view taken on line 2—2 of the apparatus of FIG. 1.
Figure 3:
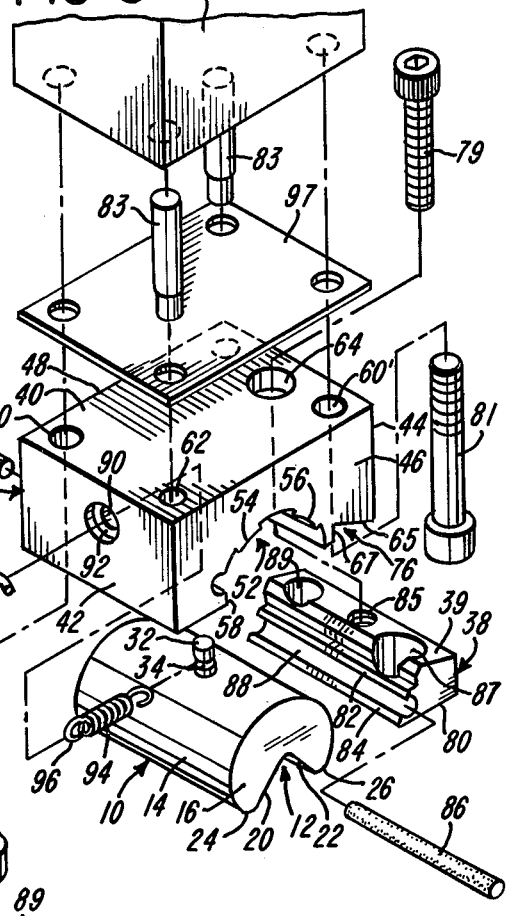
FIG. 3 is an exploded view of the apparatus of FIGS. 1 and 2, similarly oriented in a position in which the apparatus will be used in a "down bending" procedure.
Figure 4:
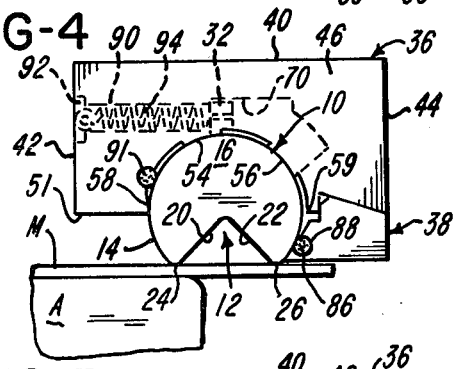
Figure 5:
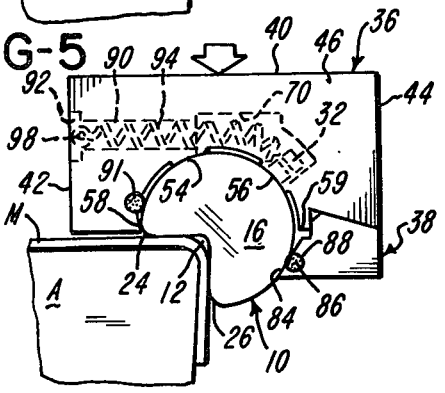
Figure 6:
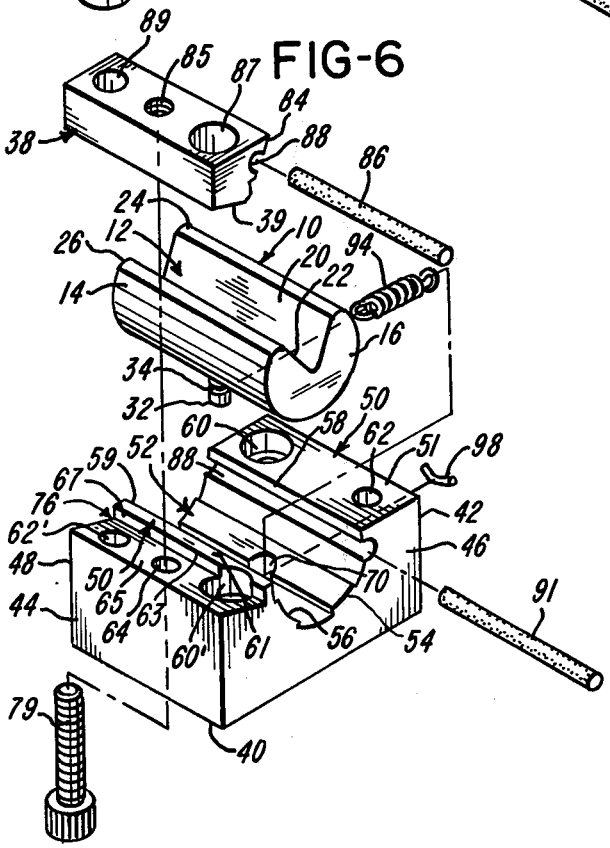

FIGS. 4 and 5 schematically illustrate the apparatus of FIGS. 1–3 in the function thereof; and FIG. 6 is an exploded view of the apparatus of FIGS. 1 and 2 illustrating such apparatus with an orientation of its parts in the position in which they must assume for an "up bending" operation.

Like parts are indicated by similar characters of reference throughout the several views.

DESCRIPTION OF A PREFERRED EMBODIMENT OF THE INVENTION:

With particular reference to the drawings, the embodiment of the invention herein illustrated provides a rotary bending and forming device comprising an operating head and its holder. The operating head is a generally cylindrical body 10 modified by having a groove 12 in and coextensive with its outer peripheral surface 14 and opening from its ends 16 and 18. The side walls 20 and 22 of the groove 12 form a symmetrical "V", which is uniform in cross section the length of the groove. The apex of the "V" is innermost of the body 10 and positions slightly short of and in a plane radial to the central longitudinal axis of the body. The apex of the "V" is normally radiused, as is each of the junctions between each of the outermost edges of the side walls 20 and 22 and the respectively adjacent portions of the outer peripheral surface 14 of the body 10. The angle defined between the side walls 20 and 22 is slightly less than 90°.

The configuration of the body 10 and the groove 12 as above described provides the body with two lobes, 24 and 26, the outermost limits of which, with reference to the central longitudinal axis of the body 10, correspond, substantially, to the outermost limits of the side wall surfaces 20 and 22 and lie in and define a common plane.

The body 10 has a radial socket 30 in the outer surface portion thereof which is diametrically opposite to the apex of the groove 12 and centered between its ends. A pin 32 which has one end anchored in the socket 30 projects outward of and radial to the body 10. The body of the pin 32 has a circumferential recess 34, located in an adjacent spaced relation to its projected extremity, the purpose of which will be further described.

The holder for the rocker element comprises a saddle 36 which seats the rocker element and a gib-like retainer 38 which holds the rocker element in a stable, balanced relation to its seat.

The saddle 36, basically formed of a rectangular block, has a rectangular planar surface 40 serving as its base, front and back surfaces 42 and 44 which are also planar and rectangular in configuration and side surfaces 46 and 48 each of which is planar. The surfaces 42, 44, 46 and 48 are equal as to their depth. Adjacent of the side, front and back surfaces are perpendicular to each other, to the base surface 40 and to the plane of the saddle's outermost surface portions 50, the latter of which laterally bound a groove 52 and the seating portion of the saddle.

The groove 52 provides a generally hemi-cylindrical cavity which is directed inwardly of the surface 50 at a location substantially centered between the front and back surfaces 42 and 44. The groove 52 extends between and has its ends at and opening from the side surfaces 46 and 48. Formed on and projected from what may be considered the innermost or base portion of the groove 52 are two narrow lands 54 and 56 which extend the length of the groove to have their ends form part of the side surfaces 46 and 48.

For convenience, the description of the saddle which follows is made with particular reference to FIG. 6. In viewing the saddle 36 from the one side 46, the width of the land 54 extends from about 4:45 to 5:30 and the width of land 56 extends from about 7:15 to 8:00, in a clockwise direction: At a location immediately of 3 o'clock and the surface 50, the side wall of the groove 52 is formed to provide thereon a narrow strip-like bearing surface portion 58 which is coextensive with the length of the groove 52. The radially innermost surfaces of the projected lands 54 and 56 at the base of the groove 52 and the bearing surface of the strip 58 are formed, in transverse section, on the same radius and, in effect, are designed so as to resemble parallel circumferentially spaced segments of the outer surface of a cylinder having such a radius. The radius on which the outer surfaces of lands 54 and 56 as well as the bearing surface of strip 58 are formed is such to complement and nest the cylindrical surface portion 14 of the body 10.

The lands 54 and 56 are the load accommodating portions of the saddle and serve to seat the body 10 as it is nested in the groove 52 to extend in a direction lengthwise thereof. In the case illustrated, the nesting of the body 10 is to the extent of approximately 180° of its circumference.

The surface portions of the wall structure bounding the groove 52, other than the portions defined by the lands 54 and 56 and the surface portion 58 are relieved. This provides recessed surface portions between the lands and to either side thereof except for the area of the surface portion 58.

A recess is formed in the surface of the wall bounding the groove 52, the length thereof, between the land 54 and the surface portion 58, in an immediately adjacent, spaced, parallel relation to the surface portion 58. The wall of this recess is arcuate in cross section and has an arcuate extent somewhat greater than 180°. This recess nests approximately three-fourths of the circumference of a lubricant impregnated cord 91 the remainder of which projects outwardly of the wall surface bounding the groove 52 to bear in wiping engagement with the outer peripheral surface 14 of the body 10.

The surface portion 58 in part defines, with the adjacent edge of a portion 51 of surface 50 with which it merges, one longitudinally extending outer edge at one side of the wall of the groove 52 which lies in the plane of the surface 50. The other longitudinally extending outer edge 59 of the wall of the groove 52 is diametrically opposite the edge 58 and also lies in the plane of the surface 50. The edge 59 forms one side of a portion 61 of the surface 50 which extends in the direction of the co-planar upper edge of surface portion 44 of the saddle. The following edge 63 of the surface portion 61 is in a closely spaced parallel relation to the edge 59 and at the same time parallel to the upper edge of surface portion 44. As will be seen from the drawings, surface portion 61 has a narrow rectangular configuration, its other edges being determined and provided by portions of the upper edges of surfaces 46 and 48. Between the limits defined by the edge 63 and the upper edge of the surface 44 the upper surface of the saddle has a notch 76 directed inwardly thereof, referenced to the plane of the surface 50 which is comprised of its portions 51 and 61. The notch 76 extends between and opens at its ends at and from the surfaces 46 and 48.

Viewed from either end thereof, in cross section the notch 76 has a uniform right triangular configuration. The notch 76 provides the saddle block 36 with an upper surface portion 65 which is inclined downwardly and inwardly from the upper edge of the surface 44 in the direction of the groove 52 and the base surface 40, at an angle with reference to the plane of the surface 50 which is preferably in the range of 10° to 25°. The surface portion 65 defines the hypotenuse of the right triangular cross section of the notch 76. The base of the right triangular configuration of this cross section is defined by a saddle surface portion 67 which is directed inwardly of and perpendicular to the plane of the surface 50, relatively shallow in depth and includes in the plane thereof the edge 63.

The gib 38 has a base portion 39 designed to provide for its complementary interfit with and to the surfaces 65 and 67 when fully seated to the saddle. Gib 38 is otherwise configured so that in the full seating thereof it presents planar surface portions which are co-planar with the surfaces 46 and 48, a rectangular planar surface portion which is coplanar with the surface 44, a rectangular surface portion 80 which positions outermost from the saddle and defines a plane parallel to and spaced outwardly from the plane of the surface 50 and a surface portion 82 which forms an acute angle with the surface 80 and is obtusely angled with reference to the base portion 39. In the seated condition of the gib a strip-like portion 84 of its surface portion 82, immediately of the surface 80, will overlie a portion of the groove 52 adjacent the edge 59. In the position thereof so established, the portion 84 of the gib surface 82 engages in a tangent, bearing, overlapping relation to a side portion of the body 10 in the saddle which extends in a direction lengthwise of its surface 14, in a line which is spaced outwardly from the plane of the surface 50 and parallel thereto as well as inwardly from and parallel to the outermost projected limits of the body 10 as seated in the saddle. This bearing engagement of the strip-like surface portion 84 of the gib 38 will be such to hold the body 10 to its load accommodating seat in the saddle. It is to be understood, of course, that the gib will be releasably anchored to the saddle at this point in time, in a manner to be further described.

The gib surface portion 82 has a longitudinally extended recess 88 therein located in an adjacent, spaced, parallel relation to its surface portion 84, to the side thereof remote from its surface portion 80. The wall of the recess 88 is arcuate in cross section and has an arcuate extent greater than 180°. The recess 88, by virtue of the nature of its cross section, nests the major extent of the circumference of a lubricant impregnated cord 86, the remainder of which projects outwardly of the wall surface portion 82 to bear in wiping engagement with the outer peripheral surface 14 of the body 10 adjacent the gib surface portion 84, when the gib is anchored to the saddle as above described. As will be noted, the inner limit of the slope of the surface portion 82 is interrupted by an offset to accommodate the forming of the gib base portion 39.

One corner of the saddle 36 has a bore 60 arranged to be perpendicular to and opening at one end from its base surface 40 and at the other end through the portion 51 of the surface 50. Bore 60 is counterbored at the surface 50 to accommodate the application therein and projection therefrom of a screw 81 to anchor the saddle to a backing structure. A second bore 62, provided in the saddle 36 at an opposite corner thereof, is arranged parallel to the bore 60 to open at one end from and through the surface portion 51 and at the other from the base surface portion 40 of the saddle. Bore 62 is designed to accommodate the application therein and the press fit to the saddle of one portion of a dowel pin 83 to have an end portion thereof project for engagement in an aligned aperture in the backing structure to which the saddle is anchored in use. Corner portions of the saddle opposite those including the bore 60 and the bore 62 are respectively provided with a bore 60' and a bore 62', respectively corresponding in detail to that of the bore 60 and the bore 62 and respectively diagonally opposite to the bores to which they correspond. The bore 60' and the bore 62' respectively will have applied thereto and therethrough a screw 81 and a dowel 83 to complete the anchoring of the saddle as it is applied to its backing structure.

A fifth bore is provided in the saddle block 36, between and in a centered and parallel relation to the bores 60' and 62'. The bore 64 is counterbored in the end thereof which opens from the surface 40.

The gib 38 is provided with three bores 85, 87 and 89, which are perpendicular to and open at one end from the surface 80 of the gib and at the opposite end from the gib base portion 39. The arrangement of the bores in the gib is such to correspond in spacing with the spacing of the bores 64, 60' and 62'. Thus, in applying the gib 38, to seat it in the notch 76 in the saddle, the bore 87 will be aligned with the bore 60'; the bore 85, which is a tapped bore, will be aligned with the bore 64 and the bore 89 will be aligned with the bore 62'. As may be seen, to releasably connect the gib 38 to the saddle 36, a screw 79 is applied through the base of the saddle block to have its threaded body portion project through the bore 64 and upwardly therefrom as its relatively enlarged head seats in the counterbore in the end thereof which opens at the surface 40. As the screw 79 is turned, the leading end thereof may be threadedly engaged in the tapped bore 85 of the gib to draw the gib base downwardly into the notch 76 until that point at which the gib is established in a relatively fixed connected relation to the saddle through the medium of its surface portion 84 achieving a bearing engagement thereof to the body 10 which holds this body to its seat in the saddle. As will be self-evident, the precise point at which the position of the gib 38 is fixed with reference to the saddle will be determined by the precise diameter of the particular body 10 which is seated in the saddle. Of course, at any time there should be wear of any nature as between the gib surface portion 84 and the surface portion 14 of the body 10, the gib is obviously adjustable. A further point which will be obvious in viewing FIGS. 2, 4 and 5 of the drawings is that the gib, if necessary, can have that portion of its base which is complementary to the surface 65 relieved to provide for a tighter fit of the gib to the body 10 or, in the alternative, have its surface portion 82 relieved to provide a freer fit of the gib to the body 10 as seated in the saddle.

A groove 70 is provided in and in a direction transversely of the base of the groove 52, centered between the saddle side surface portions 46 and 48 and parallel thereto. The arcuate extent of the groove 70 is limited. At its one end the groove 70 intersects and extends inwardly of and a fraction of the width of the land 54. From this end the groove 70 extends oppositely to and through the extent of the width of the land 56.

In seating the body 10 in the saddle 36, to the lands 54 and 56, the pin 32 slip fits into the groove 70, for movement between its side wall surfaces and within the limits defined by the respective ends of the groove.

A bore 90 is directed inwardly of the saddle surface 42, substantially perpendicular thereto, to have one end open outwardly from the surface 42 and the other end open through one end wall portion of the groove 70 in the vicinity of that side of the land 54 most adjacent the land 56. The bore 90 is counterbored at the surface 42 to form an outwardly facing shoulder 92 in a closely adjacent parallel relation to this surface. Bore 90 accommodates a coil spring 94 the innermost end of which is anchored by being coiled around the pin 32, within the recess 34. The outermost end 96 of the spring 94 is formed as a loop the position of which is established by drawing the loop 96 outwardly of the shoulder 92 and passing therethrough a pin 98 which bridges and seats to the shoulder 92, when released, under the influence of the bias of the spring 94.

Accordingly, as may be readily seen, in the assembly of the parts of the bending and forming device of the invention, the operating head defined by the cylindrical body 10 will first be nested in the groove 52 and seated on the bearing surfaces of the lands 54 and 56. In the process of the application of the body 10 in the groove 52 spring 94 previously connected at one end to the pin 32 will have its other end directed through the bore 90 from its innermost end and its looped end 96 will be pulled outwardly of the bore 90 to have passed therethrough the pin 98, upon release of which the pin 98 will bridge and anchor the outer end of the spring by engagement of the pin to and across the shoulder 92. The bias of the spring 94 will be such, as seen in FIGS. 2 and 4 of the drawings, not only to apply an influence tending to seat the body 10 in the saddle but to urge the pin 32 to move into abutment with the end of the groove 70 most adjacent the shoulder 92. This will establish the body 10 in a rotative position, particularly after the application of the gib 38 in a releasably connected relation to the saddle, such that the groove 12 will be facing directly outward of the saddle, in a centered relation to its back and front surfaces and with the outermost ends of its lobes in a common plane parallel or substantially parallel to the plane of the surface 50. Please note that the showing of the parts of the bending and forming device in FIGS. 2 and 4 is related to what their positions will be when the same parts, as shown in the exploded view of FIG. 6, are rotated 180°.

In the assembly of the gib 38 to the saddle, the screw 79 is applied through the bore 64, as previously described, to have the end thereof which is projected through and from the surface 65 engage in and in threaded relation to the tapped bore 85 as the bores 87 and 89 in the gib are held in a substantially aligned relationship to the bores 60' and 62'. As the screw 79 is turned into the bore 85, the base portion 39 of the gib is drawn towards the saddle surface 65 as well as the surface 67. The threading of the screw 79 into the gib bore 85 will continue until the surface portion 84 of the gib is brought into a bearing contacting relation to the body 10 and exerts a bearing influence sufficient to seat and hold the body 10 to the lands 54 and 56. In no case is the gib brought down so tightly to its seat in the saddle that it will clamp the body 10 and inhibit its rotation in use in a bending and/or forming operation in a press.

As will be obvious, and as previously mentioned, the gib can be adjusted not only to accommodate wear but essentially to accommodate limited differences in the diameter of the body 10 or wear of the surface 84 cn the gib at any given time. The gib 38 is therefore not only releasable and interchangeable but it is adjustable to accomodate normal discrepancies in dimensions of parts. Also, as previously noted, the gib 38 can function to establish a balance and stable relation of the body 10 to its seat in the saddle, to accommodate the necessary rotative or rocking movements of this operating head while maintaining the course of the rotating or rocking movement of the operating head repeatedly in an identical pattern, assisted in this connection by the bearing surface portion 58 in connection with the saddle.

In the case illustrated, having particular reference to FIGS. 4 and 5 of the drawings, it may be seen that the formation of the body 10 and the bias thereon by the spring 94 as well as the limits of its rotative or rocking movement, as determined by the abutment of the pin 32 with the respective ends of the groove 70, dictate that in the operation of the operating head in a press the side walls 20 and 22 defining its groove will move through an arc of 45°.

It must be clearly understood that the limit of movement of the gib in the first instance, in the application thereof in the notch 76 of the saddle 36, will be determined by that point at which the gib surface portion 84 comes into a bearing contacting relation with the outer surface of the body 10 to exert a holding function. The point of bearing contact will be determined by the original diameter of the outer peripheral surface 14 of the body 10.

It should therefore be clear that the construction and arrangement provides that there is a bearing relation as between the holder and the operating head of embodiments of the invention that provides a concentration of applied load which is borne by a dual bearing surface. This doubles the load carrying capacity of the invention embodiments as contrasted to that of the prior art devices which are applied to the same purpose.

The spring 94 and its return function is not absolutely required, particularly for all applications. However, its use will insure a simple initial coupling of the operating head to the saddle 36 and a quick return of the operating head to its ready position subsequent to the completion of a stroke thereof in the course of which it serves a bending and/or forming function.

As will be obvious from the foregoing, the use of a multi part structure such as herein described facilitates the assembly of the bending and forming apparatus and enables that the same may be accomplished quickly and economically. The same result is found in the course of maintenance and replacement of parts of an embodiment such as herein described. In any case, maintenance procedures will be minimalized because of the nature and character of the construction provided. Apart from this, the assembly of the devices of the invention is foolproof and if for any reason the body 10 should fracture, its parts would be held in place for a considerable period of time, thereby minimizing the likelihood of the dropping of the parts of the tool and causing damage to the equipment and material with which it is associated.

A most important benefit of the mount of the body 10 as described and illustrated is that it provides a very stable, balanced and most effective operation of the body, insurance being given as to the repetition of its performance. Inherently found in the use of the invention is that the body 10 does not skid or mark the material on which it operates in any damaging or disadvantageous manner.

While FIGS. 4 and 5 of the drawings illustrate the application of the invention embodiment to material M backed in part by a forming die A to form in such material a 90° bend, the details of the bending operation are neither shown nor particularly described since they are well known in the art and are particularly exhibited in the prior art evidenced by U.S. Pat. No. 4,002,049 referred to above in the first instance. Furthermore, while the exploded view of FIG. 3 provides an illustration of the manner of fixing the saddle to a backing structure, only so much of the backing structure is illustrated as may be necessary for an understanding in this respect. Thus, as seen in FIG. 2 the saddle will be backed by a wear plate 97 which is backed in turn by a spacer block 99 and the latter will be anchored to a forming die in connection with the ram in a press. This is purely by way of illustration and not by way of limitation. Since the use of the apparatus shown and described will be clear to those versed in the art, any details of backing structure, other tool and die structure which might be used in conjunction therewith and the press structure such as that in which they might be incorporated has been avoided to insure a clear presentation of the invention and its benefits.

Of course, the invention has been described herein with particular reference to a preferred embodiment. It nevertheless remains that those versed in the art will be able to adapt various forms of holder devices and rocker units or elements to incorporate one or more of the features illustrated which lend significant benefits and advance in the art.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A bending and forming device comprising an operating head and a holder for said head wherein said operating head is a generally cylindrical body including a longitudinally extending groove in its outer peripheral surface, said head mounting for rotation on and relative to said holder and presenting the groove therein to the materials to be worked in its bending and forming function, said holder including means defining a saddle for seating said head, said saddle comprising a body having a base, a longitudinally extended substantially hemi-cylindrical groove in a surface thereof remote from its base, a wall surface bounding said groove which incorporates two longitudinally extending bearing portions bounding a strip-like, relatively recessed, portion of said wall surface therebetween and affording a load accommodating seat for said cylindrical body, means defining a retention device mounted on said saddle, in releasable connection therewith and to one side of said groove therein, constructed and arranged to have only a limited surface portion thereof overlie and bear on a portion of said operating head to hold said head to and for a balanced rocking or rotative movement on said seat, said wall surface bounding said groove including therein a longitudinally extending recess partially nesting a cord-like segment of material which is impregnated with lubricant the projected portion of which bears on said cylindrical body in the course of its rocking or rotative movement on and with reference to said seat.

2. Apparatus as in claim 1 characterized in that said limited surface portion of said retention device has an elongated strip-like form coextensive with the longitudinal extent of said retention device in which it is embodied and immediately thereof, nested in and projected from said retention device, a cord-like strip of lubricant impregnated material for lightly bearing on said body and in the course of its rocking or rotative movement.

3. Apparatus for holding a roller or rocker type head to provide a bending and forming device comprising means defining a load accommodating seat for said head, said load accommodating seat being comprised of a pair of longitudinally extending, laterally spaced bearing portions, and means providing a strip-like bearing portion to one side of and spaced outwardly from said means defining said seat constructed and arranged to lightly bear on and define a control for the position of said head in the course of a rocking or rotative movement thereof on said seat.

4. Apparatus as in claim 3 wherein said strip-like bearing portion is part of means defining an extension of said pair of bearing portions, said means defining said extension is releasably connected to and positioned outwardly of and at one side of said means defining said seat, and said strip-like bearing portion is in an overlying relation to a limited portion of one side of said head in an area thereof projected outwardly of said means defining said seat to serve as the means which contains said head to said seat during the course of its function.

5. Apparatus as in claim 3 wherein said means defining said load accommodating seat includes a saddle for said head including a base surface and a surface remote from and opposite to said base surface, said remote surface including a longitudinally extended groove having a bounding wall surface embodying said pair of laterally spaced bearing portions as projected lands which run substantially the length thereof, a gib releasably connected to said saddle and positioned to one side of the head which seats therein, said gib having a side surface thereof a limited portion of which projects in the direction of said head to provide said strip-like bearing portion.

6. Apparatus as set forth in claim 3 wherein said means defining said load accommodating seat comprises a saddle a surface of which has a hemi-cylindrical groove, the bounding wall surface of which includes said pair of laterally spaced bearing portions and a longitudinally extending recess partially nesting a cord-like segment of material which is impregnated with lubricant the projected portion of which bears on a portion of the body of the head in the course of a rocking or rotative movement thereof on its seat.

7. A bending and forming device as in claim 3 including a head having a generally cylindrical body and a longitudinally extending groove in its outer peripheral surface the side walls of which relatively diverge in a direction outwardly of said body, said means defining a load accommodating seat comprising a saddle a recessed portion of the outermost surface of which nests said cylindrical body, said pair of laterally spaced bearing portions providing dual bearing surfaces for said body and serving as a base for concentrating the load applied to said body in the working of material thereby, said dual bearing surfaces being extended in a direction longitudinally of said body and in a side-by-side, relatively closely spaced relation, said saddle having a separable outward extension limited to one side of said recessed portion of its outermost surface, said extension including, as a part thereof, said strip-like bearing portion which projects to overlap a longitudinally extending strip-like surface portion of said body and bear thereon in a line substantially parallel to said dual bearing surfaces.

8. A device as in claim 7, said extension including a portion nesting inwardly of a portion of the outermost surface of said saddle adjacent said one side of said recessed portion and having a side surface portion thereof projecting outwardly from said saddle in an initially spaced relation to said head and outwardly of said saddle includes a portion thereof which is projected to and provides said strip-like bearing portion for containing said head to said dual bearing surfaces.

9. Apparatus as in claim 7, said means defining said load accommodating seat including a surface from which said laterally spaced bearing portions project as lands and seat thereon a head having a cylindrical form and a groove therein the length thereof, which groove is continuously presented to the material to be worked by said head, said surface partially bounding and nesting said head and being extended by means releasably connected to said means defining a seat for said head, to one side of said head, said releasably connected means including said strip-like bearing portion and said surface embodying therein a plurality of longitudinally extending recesses each partially nesting a cord-like segment of material which is impregnated with lubricant the projected portion of which bears on said head in the course of a rocking or rotative movement thereof on and with reference to said seat, said segments respectively positioning to bear on opposite sides of said head.

* * * * *

UNITED STATES PATENT AND TRADEMARK OFFICE

CERTIFICATE OF CORRECTION

PATENT NO. : 4,434,644

DATED : March 6, 1984

INVENTOR(S) : Robert J. Gargrave; John K. Thompson; and James F. Comstock

It is certified that error appears in the above-identified patent and that said Letters Patent are hereby corrected as shown below:

Col. 1, line 48, a comma is inserted following "parallel".

Col. 8, line 11, "cn" is corrected to read -- on --.

Col. 12, line 10 (Claim 9, line 1) "7" is corrected to read -- 3 --.

Signed and Sealed this

*Twenty-first* Day of *August 1984*

[SEAL]

*Attest:*

GERALD J. MOSSINGHOFF

*Attesting Officer*

*Commissioner of Patents and Trademarks*